US012135020B2

(12) United States Patent
Yang et al.

(10) Patent No.: US 12,135,020 B2
(45) Date of Patent: Nov. 5, 2024

(54) PUMP BODY, COMPRESSOR, AND HEAT EXCHANGE APPARATUS

(71) Applicant: GREE GREEN REFRIGERATION TECHNOLOGY CENTER CO., LTD. OF ZHUHAI, Qianshan Zhuhai (CN)

(72) Inventors: Sen Yang, Zhuhai (CN); Yusheng Hu, Zhuhai (CN); Jia Xu, Zhuhai (CN); Huijun Wei, Zhuhai (CN); Liping Ren, Zhuhai (CN); Zhongcheng Du, Zhuhai (CN); Zhi Li, Zhuhai (CN); Peilin Zhang, Zhuhai (CN)

(73) Assignee: Gree Green Refrigeration Technology Center Co., Ltd, of Zhuhai, Zhuhai (CN)

( * ) Notice: Subject to any disclaimer, the term of this patent is extended or adjusted under 35 U.S.C. 154(b) by 473 days.

(21) Appl. No.: 17/620,589

(22) PCT Filed: Jun. 24, 2020

(86) PCT No.: PCT/CN2020/098193
§ 371 (c)(1),
(2) Date: Dec. 17, 2021

(87) PCT Pub. No.: WO2021/004294
PCT Pub. Date: Jan. 14, 2021

(65) Prior Publication Data

US 2022/0412332 A1 Dec. 29, 2022

(30) Foreign Application Priority Data

Jul. 9, 2019 (CN) ..... 201910616825.9

(51) Int. Cl.
*F04B 39/00* (2006.01)
*F04B 39/10* (2006.01)
*F04B 39/12* (2006.01)

(52) U.S. Cl.
CPC ..... *F04B 39/0005* (2013.01); *F04B 39/1066* (2013.01); *F04B 39/121* (2013.01)

(58) Field of Classification Search
CPC ..... F04B 35/01; F04B 39/122; F04B 39/121; F04B 39/0005
See application file for complete search history.

(56) References Cited

U.S. PATENT DOCUMENTS

2016/0186743 A1 6/2016 Thompson et al.
2018/0245591 A1* 8/2018 Hu ..... F04C 29/02

FOREIGN PATENT DOCUMENTS

CN 103904848 A 7/2014
CN 106704183 A 5/2017
(Continued)

OTHER PUBLICATIONS

Office Action mailed Jan. 17, 2023, in corresponding Japanese application No. 2021-572422 (Japanese version), filed Jun. 24, 2020, 8 pages.
(Continued)

*Primary Examiner* — Abiy Teka
(74) *Attorney, Agent, or Firm* — Christensen O'Connor Johnson Kindness PLLC

(57) ABSTRACT

The present disclosure provides a pump body, a compressor, and a heat exchange apparatus. The pump body includes a cylinder assembly, a piston, a motion transmission structure, and a drive member. The cylinder assembly includes a cylinder. The piston is movably disposed in the cylinder. The drive member is connected to the piston through the motion transmission structure. An outer peripheral wall of the piston has a rail groove connected end to end in a circumferential direction, and the cylinder has a guide structure extending into the rail groove; or an inner surface of the cylinder has a rail groove connected end to end in the circumferential direction, and the piston has a guide structure extending into
(Continued)

the rail groove. So that through driving of the piston by the drive member, the piston is capable of rotating relative to the cylinder while reciprocating along a rotating axis of the piston.

17 Claims, 9 Drawing Sheets

(56) References Cited

FOREIGN PATENT DOCUMENTS

| | | | | |
|---|---|---|---|---|
| CN | 106999967 | A | | 8/2017 |
| CN | 109595157 | A | | 4/2019 |
| CN | 110185596 | A | | 8/2019 |
| CN | 110242535 | A | | 9/2019 |
| CN | 210637201 | U | | 5/2020 |
| CN | 210637203 | U | | 5/2020 |
| JP | 53057508 | A | | 11/1976 |
| JP | 57122086 | A | | 7/1982 |
| JP | 1996144948 | A | | 6/1996 |
| JP | 1997096275 | A | | 4/1997 |
| JP | 2004263656 | A | | 9/2004 |
| JP | 2006329060 | A | | 12/2006 |
| JP | 2009052540 | A | * | 3/2009 |
| JP | 2014015883 | A | | 1/2014 |
| WO | 2007021581 | A2 | | 2/2007 |

OTHER PUBLICATIONS

PCT International Searching Authority, International Search Report mailed Sep. 27, 2020, issued in corresponding International Application No. PCT/CN2020/098193, filed Jun. 24, 2020, 3 pages.

* cited by examiner

PUMP BODY, COMPRESSOR, AND HEAT EXCHANGE APPARATUS

CROSS-REFERENCE TO RELATED APPLICATION

This application is a National Stage of International Application No. PCT/CN2020/098193, filed Jun. 24, 2020 which claims priority of China Patent Application No. 201910616825.9, filed on Jul. 9, 2019, the content of which is hereby incorporated by reference in its entirety.

TECHNICAL FIELD

The present disclosure relates to the field of compressor equipment, and in particular, to a pump body, a compressor, and a heat exchange apparatus.

BACKGROUND

In the piston compressor based on linkage transmission known to the inventors, the rotation direction of the main shaft and the reciprocating direction of the piston are perpendicular to each other, and the piston reciprocates relative to the cylinder.

SUMMARY

According to one aspect of the present disclosure, a pump body is provided, which includes a cylinder assembly, a piston, a motion transmission structure, and a drive member. The cylinder assembly includes a cylinder. The piston is movably disposed in the cylinder. The drive member is drivingly connected to the piston through the motion transmission structure. An outer peripheral wall of the piston has a rail groove connected end to end in a circumferential direction, and the cylinder has a guide structure extending into the rail groove; or an inner surface of the cylinder has a rail groove connected end to end in the circumferential direction, and the piston has a guide structure extending into the rail groove. So that through driving of the piston by the drive member, the piston is capable of rotating relative to the cylinder while reciprocating along a rotating axis of the piston.

In some embodiments, the rail groove is a continuous wave-shaped curved line rail groove.

In some embodiments, the wave-shaped curved line rail groove is a sine or cosine wave-shaped curved line rail groove.

In some embodiments, numbers of crests and troughs of the sine or cosine wave-shaped curved line rail groove in the circumferential direction of the cylinder or the piston are equal, and both are greater than or equal to 2.

In some embodiments, the piston has one or a plurality of guide structures. When the piston has the plurality of guide structures, the number of the guide structures is equal to or smaller than the number of the crests, and the plurality of guide structures are in a same radial plane of the piston.

In some embodiments, the piston has one or a plurality of guide structures, and a displacement (Vone) of the pump body satisfies the following relationship:

$$Vone=K1*K2*A*S \quad \text{formula (1)}$$

wherein K1 is a coefficient, and K1 is an integer greater than zero; K2 is the number of the guide structure; A is the amplitude of the sine or cosine wave-shaped curved line rail groove; S is the area of an end surface of the piston, and the end surface faces a compression cavity of the cylinder.

In some embodiments, the guide structure includes a pin extending into the rail groove.

In some embodiments, the guide structure includes a rolling bearing extending into the rail groove.

In some embodiments, the motion transmission structure includes a shaft member. The shaft member is arranged coaxially with the rotating axis of the piston. The piston is sleeved on the shaft member. When the shaft member rotates, the piston rotates synchronously with the shaft member and slides back and forth along the rotating axis.

In some embodiments, a first end of the shaft member extends into the piston. The drive member is located at a second end of the shaft member, and the shaft member includes a first circumferential anti-rotation structure located at the end extending into the piston. The piston includes a second circumferential anti-rotation structure that cooperates with the first circumferential anti-rotation structure.

In some embodiments, the first circumferential anti-rotation structure is a guide groove located on an outer peripheral surface of the shaft member and extending along an axial direction of the shaft member, the second circumferential anti-rotation structure is a guide protrusion extending into the guide groove, and with movement of the piston, the guide protrusion moves back and forth in the guide groove. Alternatively, the second circumferential anti-rotation structure is a guide groove located on the piston and extending along the rotating axis, the first circumferential anti-rotation structure is a guide protrusion extending into the guide groove, and with movement of the piston, the guide protrusion moves back and forth in the guide groove.

In some embodiments, a cross section of the end of the shaft member extending into the piston is a non-circular cross section.

In some embodiments, an outer peripheral surface of the end of the shaft member extending into the piston includes a first radial-support arc surface, a first circumferential-support flat surface, a second circumferential-support flat surface, a third circumferential-support flat surface, a second radial-support arc surface, a fourth circumferential-support flat surface, a fifth circumferential-support flat surface, a sixth circumferential-support flat surface, wherein the first radial-support arc surface and the second radial-support arc surface are symmetrically arranged, the second circumferential-support flat surface and the fifth circumferential-support flat surface are symmetrically arranged, the first circumferential-support flat surface and the third circumferential-support flat surface are symmetrically arranged, and the fourth circumferential-support flat surface and the sixth circumferential-support flat surface are symmetrically arranged.

In some embodiments, the cross-sectional area of the first end of the shaft member is larger than the cross-sectional area of the second end of the shaft member.

In some embodiments, the rail groove is located on the outer peripheral wall of the piston, and the motion transmission structure includes a shaft member. A first end of the shaft member extends into the piston. The outer peripheral wall of the piston has an oil groove. The piston includes at least one piston radial oil-port and at least one piston central oil-port. The piston radial oil-port is disposed in at least one of a bottom wall of the oil groove and a bottom wall of the rail groove. The piston radial oil-port is communicated with the shaft member located in the piston through the piston central oil-port.

In some embodiments, the shaft member includes a shaft member central oil-port and a shaft member radial oil-port communicated with each other, and the shaft member central oil-port penetrates an end surface of the shaft member in an axial direction.

In some embodiments, the pump body further includes a support shaft. The support shaft supports a second end of the shaft member. The support shaft includes a support shaft central oil-port and at least one support shaft radial oil-port. The support shaft central oil-port is communicated with the shaft member central oil-port. When the support shaft includes a plurality of support shaft radial oil-ports, the plurality of support shaft radial oil-ports are spaced from each other along an axial direction of the support shaft.

In some embodiments, the outer peripheral wall of the piston is further provided with a clearance slot, and the clearance slot is located between the rail groove and the oil groove.

In some embodiments, the cylinder includes a cylinder body and a support protrusion. The support protrusion is arranged on an end surface of the cylinder body facing the motion transmission structure, and the guide structure is disposed on the support protrusion.

In some embodiments, the cylinder assembly further includes a cylinder cover, a gas discharge valve assembly, and a gas suction valve assembly; the gas suction valve assembly is disposed between the cylinder and the cylinder cover, and the gas discharge valve assembly is disposed on a cylinder cover gas exhaustion port of the cylinder cover.

In some embodiments, the gas suction valve assembly includes a gas suction valve plate washer and a gas suction valve plate. The gas suction valve plate washer has a ring shape. The gas suction valve plate is disposed between the cylinder cover and the gas suction valve plate washer. The gas suction valve plate has a gas suction port and a spring plate movably disposed at the gas suction port, the spring plate is configured to open during gas suction of the pump body, the gas suction valve plate also has a valve plate gas discharge port disposed corresponding to the cylinder cover gas exhaustion port In some embodiments, the spring plate is disposed at the valve plate gas discharge port.

In some embodiments, the spring plate is formed from a part of the gas suction valve plate by cutting, and is integrated with the gas suction valve plate. An opening formed by the cutting forms the gas suction port.

In some embodiments, movement of the piston relative to the cylinder satisfies a trigonometric function, and a center of mass of the cylinder corresponds to a balance surface where the amplitude of the trigonometric function is zero, a center of mass of the piston continuously moves relative to the balance surface during the movement of the piston to form a trigonometric function curve.

According to another aspect of the present disclosure, a compressor including the above-described pump body is provided.

According to another aspect of the present disclosure, a heat exchange apparatus including the above-described compressor is provided.

In some embodiments, the heat exchange apparatus is an air conditioner.

BRIEF DESCRIPTION OF THE DRAWINGS

The accompanying drawings of the specification constituting a part of the present disclosure are used to provide a further understanding of the present disclosure, and the exemplary embodiments and descriptions of the present disclosure are used to explain the present disclosure, and do not constitute an improper limitation of the present disclosure. In the drawings.

Figure 1:
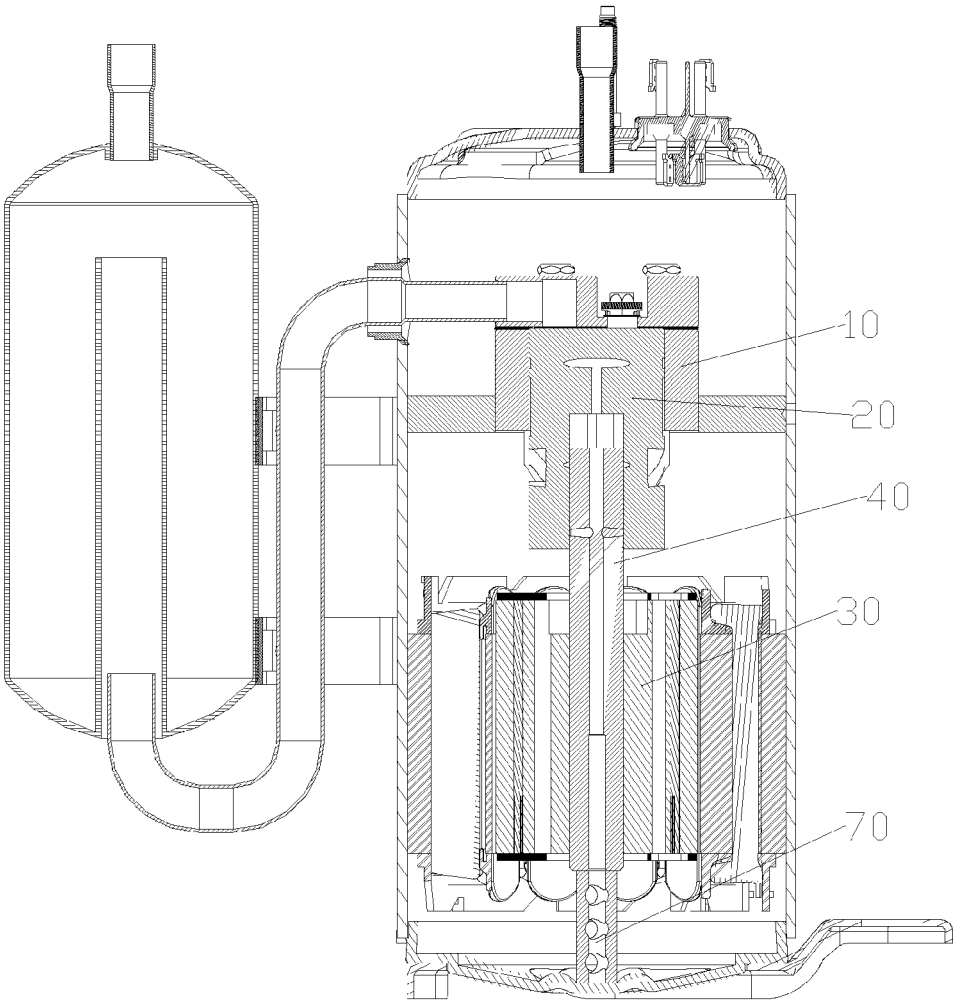
FIG. 1 shows a schematic structural view of a compressor according to an embodiment of the present disclosure.

The above drawings include following reference signs:

10. cylinder assembly; 11. cylinder; 111. guide structure; 112. cylinder body; 113. support protrusion; 12. rolling bearing; 13. cylinder cover; 131. cylinder cover gas exhaustion port; 14. gas discharge valve assembly; 15. gas suction valve assembly; 151. gas suction valve plate washer; 152. gas suction valve plate; 1521. gas suction port; 1522. spring plate; 1523. valve plate gas discharge port; 20. piston; 21. rail groove; 211. piston radial oil-port; 22. oil groove; 23. piston central oil-port; 24. clearance slot; 30. drive member; 40. motion transmission structure; 41. first radial-support arc surface; 42. first circumferential-support flat surface; 43. second circumferential-support flat surface; 44. third circumferential-support flat surface; 45. second radial-support arc surface; 46. fourth circumferential-support flat surface; 47. fifth circumferential-support flat surface; 48. sixth circumferential-support flat surface; 49. shaft member central oil-port; 491. shaft member radial oil-port; 50. guide groove; 60. guide protrusion; 70. support shaft; 71. support shaft central oil-port; 72. support shaft radial oil-port.

DETAILED DESCRIPTION

The embodiments in the present disclosure and the features in the embodiments can be combined with each other if there is no conflict. Hereinafter, the present disclosure will be described in detail with reference to the drawings and in conjunction with the embodiments.

Unless otherwise specified, all technical and scientific terms used in the present disclosure have the same meaning as commonly understood by those of ordinary skill in the technical field to which the present disclosure belongs.

In the present disclosure, if there is no explanation to the contrary, the orientation terms used, such as "up", "down", "top", "bottom" are usually used to describe directions shown in the drawings, or in terms of vertical, perpendicular, or gravitational direction. Similarly, for ease of understanding and description, "inner" and "outer" refers to the inner and outer relative to the contour of the component itself. The above-described directional terms does not constitute limitation to the present disclosure.

It is found through research that in the piston compressor based on linkage transmission known to the inventors, the linkage transmission has a large efficiency loss, and the main shaft has an eccentric structure, which requires a balanced structure, while a multi-stage piston compressor has a more complicated structure.

In view of this, an embodiment of the present disclosure provides a pump body, a compressor, and a heat exchange apparatus, which can improve the performance of the compressor. In some embodiments, the heat exchange apparatus in the present disclosure includes the compressor. Referring to FIG. 1, the compressor has the pump body as described below. In some embodiments, the heat exchange apparatus is an air conditioner.

Referring to FIGS. 2 to 16, in some embodiments of the present disclosure, the pump body includes a cylinder assembly 10, a piston 20, a drive member 30, and a motion transmission structure 40. The cylinder assembly 10 includes a cylinder 11, the piston 20 is movably disposed in the cylinder 11, and the drive member 30 is drivingly connected to the piston 20 through the motion transmission structure 40, so that the piston 20 is capable of rotating relative to the cylinder 11 while moving back and forth along a rotating axis of the piston 20 in the cylinder 11.

Using the pump body of the above structure, when the motion transmission structure 40 rotates relative to the cylinder 11, for the reason that the piston 20 is capable of not only moving back and forth relative to the cylinder 11 but also rotating relative to the cylinder 11, and the piston 20 always stays coaxially with the motion transmission structure 40 during the movement, thus, the efficiency of the pump body is effectively improved, and the eccentric rotation problem of the structure is solved.

In addition, since the piston 20 has a rotational movement relative to the cylinder 11, gas leakage of the cylinder 11 can also be effectively reduced.

Referring to FIGS. 2 to 8, an outer peripheral wall of the piston 20 is provided with a rail groove 21 which is connected end to end along a circumferential direction of the outer peripheral wall, and the cylinder 11 is provided with a guide structure 111 extending into the rail groove 21. With this arrangement, when the piston 20 moves relative to the cylinder 11, the piston 20 and the cylinder 11 can keep connecting with each other through the guide structure 111 and the rail groove 21, and when the piston 20 moves relative to the cylinder 11, the guide structure 111 is always kept inside the rail groove 21, thereby being able to limit the movement direction of the piston 20.

In some embodiments, an inner surface of the cylinder 11 is provided with the rail groove 21 connected end to end along a circumferential direction of the inner surface, and the piston 20 is provided with the guide structure 111 extending into the rail groove 21. When using this arrangement, the cylinder 11 can have a structure with separate parts to facilitate the installation of the cylinder 11 and the piston 20.

In some embodiments, the rail groove 21 is a continuous wave-shaped curved line rail groove. For the reason that the movement of the piston 20 relative to the cylinder 11 not only includes back and forth movement relative to the cylinder 11, but also includes rotation relative to the cylinder 11, the rail groove 21 is in the form of a continuous wave-shaped curved line. The rail groove 21 is continuous so as to ensure that the piston 20 can rotate relative to the cylinder 11, and rail groove 21 is in the form of a continuous wave-shaped curved line so as to ensure that the piston 20 can move up and down relative to the cylinder 11.

In the above-described wave-shaped curved line rail groove, the wave-shaped curved line is a continuous wave-shaped curved line. In other embodiments, the wave-shaped curved line is a polygonal chain, and the wave-shaped curved line rail groove is a non-straight rail groove with risings and fallings. Due to the risings and fallings of the rail groove, the piston 20 can realize the process of suction, compression, and exhaust when the piston 20 moves relative to the cylinder 11.

In order to ensure the working effect of the pump body, in some embodiments of the present disclosure, the wave-shaped curved line rail groove 21 is a sine or cosine wave-shaped curved line rail groove. With this arrangement, the movement trajectory of the piston 20 can be more regular, so that the piston 20 and the cylinder 11 can regularly complete the suction, compression, and exhaust.

In some embodiments, the numbers of crests and troughs of the sine or cosine wave-shaped curved line rail groove in the circumferential direction of the cylinder 11 or the piston 20 are equal, and both are greater than or equal to 2. During the movement of the piston 20, each time the rotating piston 20 passes through a continuous wave crest and trough, the process of suction, compression, and exhaust is completed. Therefore, when the numbers of crests and troughs are the same and both are greater than or equal to 2, the piston 20 can complete processes of suction, compression, and exhaust more than twice by rotating for one revolution, thereby effectively improving the work efficiency of the pump body. Moreover, this arrangement also realizes the multi-stage compression of a single cylinder 11, and has a simple structure compared to the compressor having multiple cylinders and pistons 20.

Figure 2:
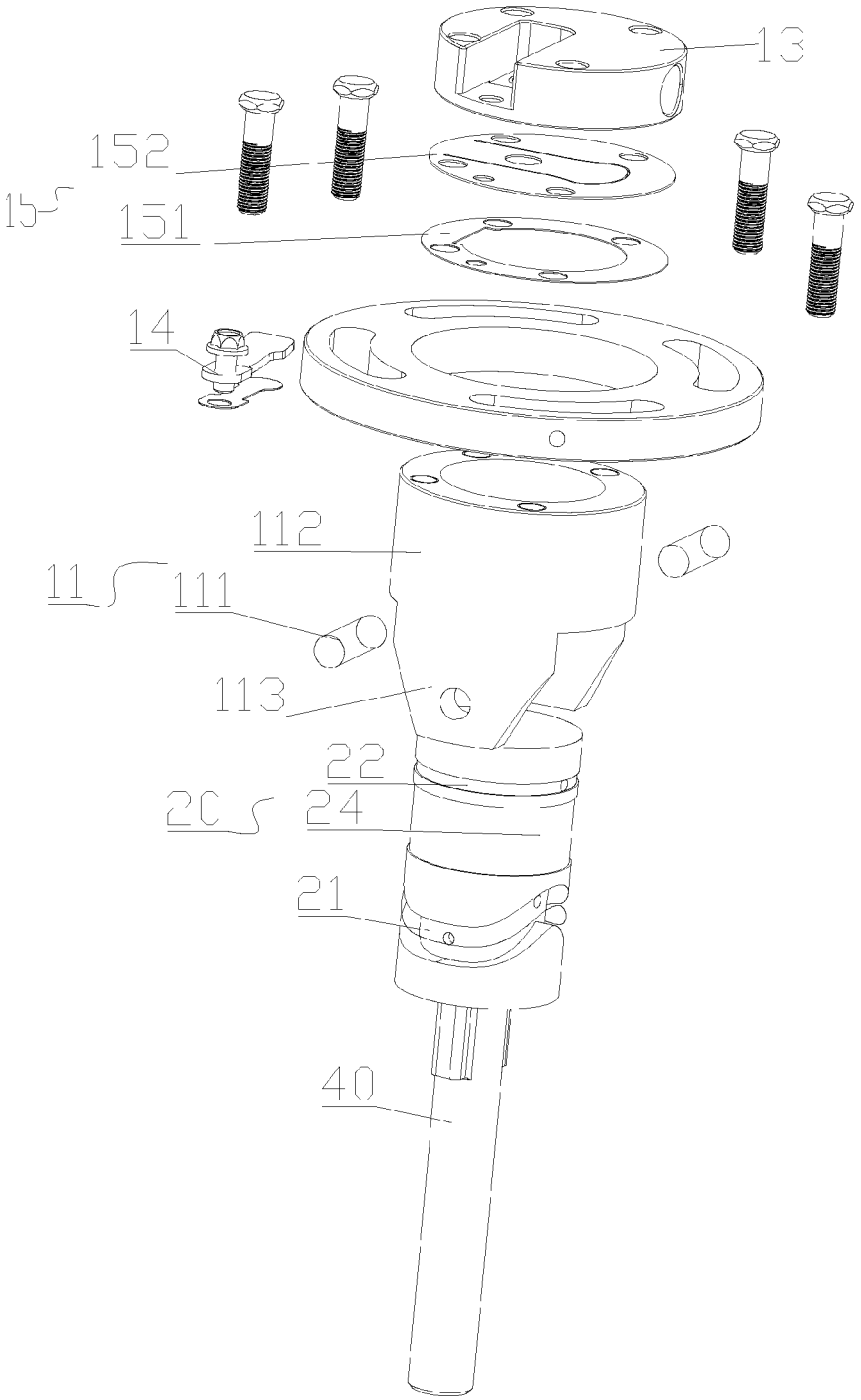
FIG. 2 shows an exploded view of a pump body of the compressor in FIG. 1.
Figure 3:
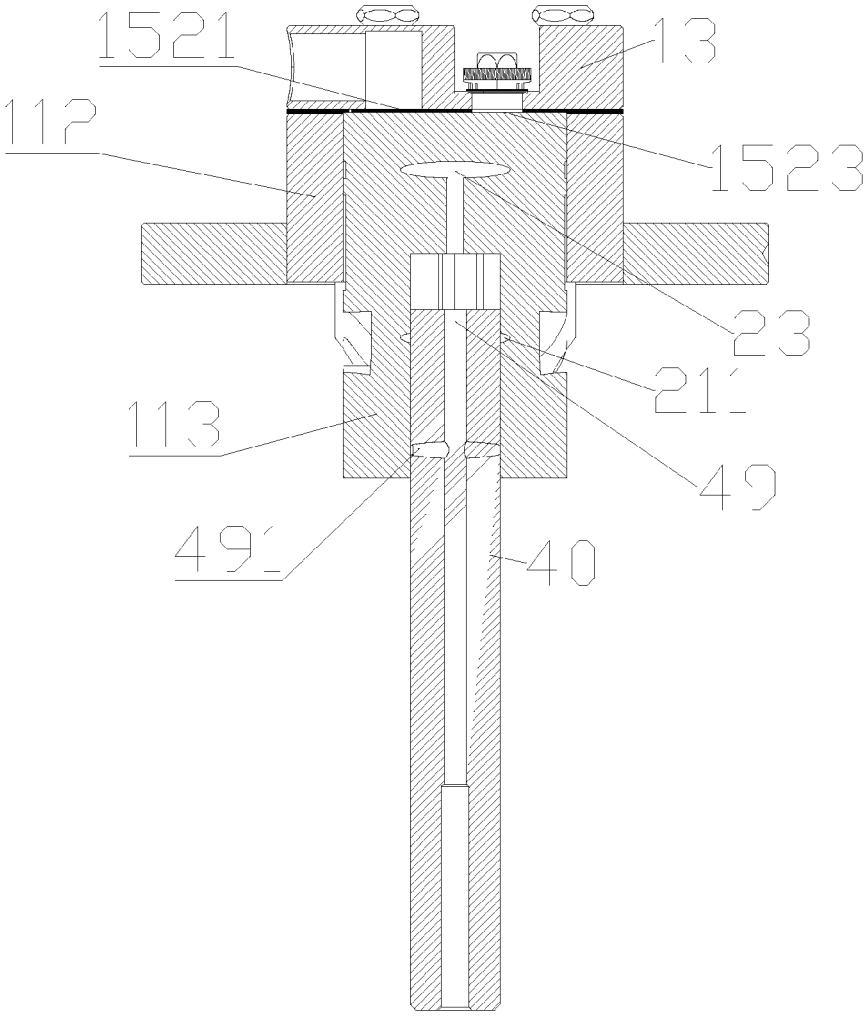
FIG. 3 shows a cross-sectional view of the pump body in FIG. 2.
Figure 4:
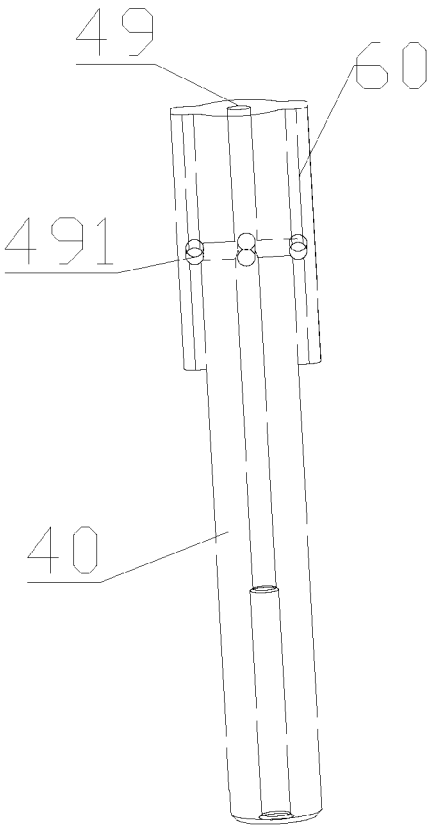
FIG. 4 shows a schematic structural view of a motion transmission structure in FIG. 2.

Referring to FIG. 2, the number of guide structure 111 is one or more. When the number of guide structures 111 is more than one, the number of guide structures 111 is not more than the number of crests, and the plurality of guide structures 111 are located in the same radial plane of the piston 20. The piston 20 not only rotates relative to the cylinder 11, but also moves back and forth relative to the cylinder 11, and the guide structures 111 are always located inside the rail groove 21 during the movement of the piston 20. Therefore, in order to ensure the normal movement of the piston 20, one guide structure 111 is located between adjacent crests and troughs, and all the guide structures 111 are located in the same plane.

In some embodiments, the number of guide structure 111 is one or more, and a displacement (Vone) of the pump body satisfies the following relationship:

$$Vone = K1 * K2 * A * S \qquad \text{formula (1)}$$

wherein K1 is a coefficient, and K1 is an integer greater than zero; K2 is the number of the guide structures 111; A is the amplitude of the sine or cosine wave-shaped curved line rail groove; S is the area of an end surface of the piston 20, and the end surface faces a compression cavity of the cylinder 11.

In the above description, K1*K2 is the number of sine or cosine periods or the number of crests or troughs of the rail groove 21.

In some embodiments, the guide structure 111 is a pin extending into the rail groove 21. In other embodiments, other parts with certain strength are selected as the guide structures 111.

Figure 16:
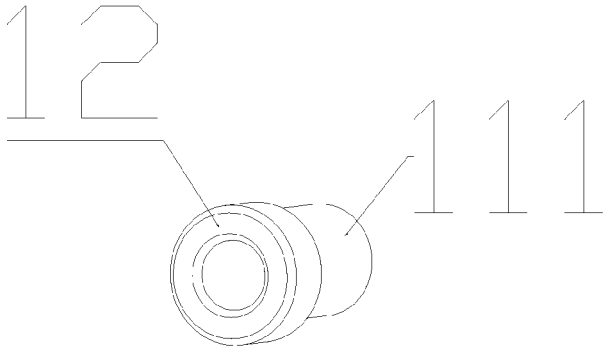
FIG. 16 shows a connection between a guide structure and a rolling bearing in the present disclosure.

Referring to FIG. 16, an end of the guide structure 111 extending into the rail groove 21 includes a rolling bearing 12. Since the guide structure 111 and the rail groove 21 also have relative movement during the movement of the piston 20, in order to reduce the effect of resistance generated by the guide structure 111 and the rail groove 21 on the movement of the piston 20, the rolling bearing 12 is disposed at the end of the guide structure 111 extending into the rail groove 21 to reduce resistance.

In some embodiments, the motion transmission structure 40 is a shaft member. The shaft member is arranged coaxially with the rotating axis of the piston 20. The piston 20 is sleeved on the shaft member. When the shaft member rotates, the piston 20 rotates synchronously with the shaft member and slides back and forth along the shaft member.

In some embodiments, a first end of the shaft member extends into the piston 20. The drive member 30 is located at a second end of the shaft member. The end of the shaft member that extends into the piston 20 is provided with a first circumferential anti-rotation structure, the piston 20 is provided with a second circumferential anti-rotation structure that cooperates with the first circumferential anti-rotation structure. With this arrangement, the relative rotation between the piston 20 and the shaft member is prevented, thereby ensuring the synchronous rotation of the piston 20 and the shaft member.

Although there is no relative rotation between the piston 20 and the shaft member, the piston 20 must be able to move back and forth on the shaft member relative to the cylinder 11 along the axis of the shaft member in order to ensure that the piston 20 is capable of moving back and forth relative to the cylinder 11, thereby ensuring that the pump body can normally perform the process of suction, compression, and exhaust.

In some embodiments of the present disclosure, the second circumferential anti-rotation structure is a guide groove 50 located on the piston 20 and extending along the rotating axis of the piston 20, and the first circumferential anti-rotation structure is a guide protrusion 60 extending into the guide groove 50. With the movement of the piston 20, the guide protrusion 60 moves back and forth in the guide groove 50.

In some embodiments, the first circumferential anti-rotation structure is a guide groove 50 located on an outer peripheral surface of the shaft member and extending along an axial direction of the shaft member, and the second circumferential anti-rotation structure is a guide protrusion 60 extending into the guide groove 50. With the movement of the piston 20, the guide protrusion 60 moves back and forth in the guide groove 50.

In some embodiments, in order to prevent the relative rotation between the piston 20 and the shaft member, the cross-section of the end of the shaft member extending into the piston 20 is a non-circular cross-section.

Figure 5:
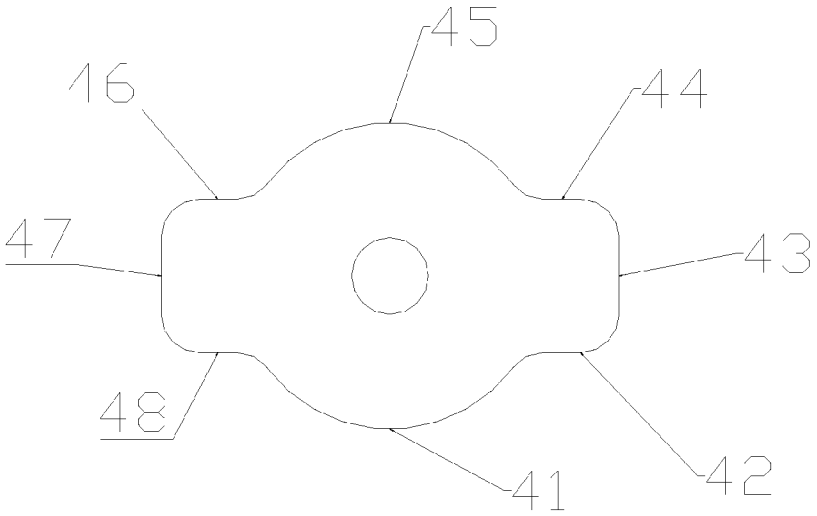
FIG. 5 shows a top view of the motion transmission structure in FIG. 4.
Figure 6:
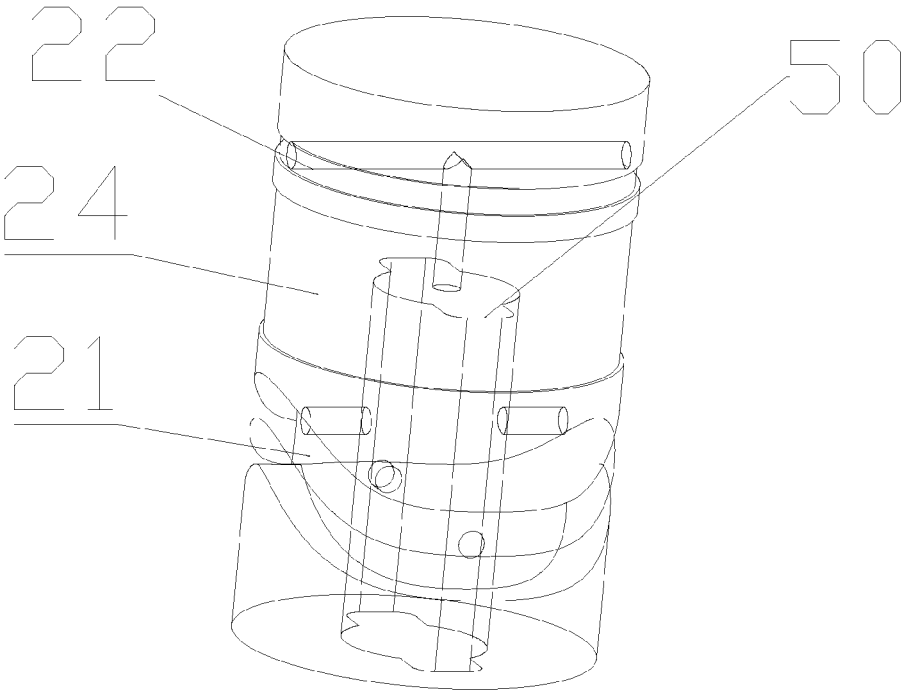
FIG. 6 shows a schematic structural view of a piston in FIG. 2.
Figure 7:
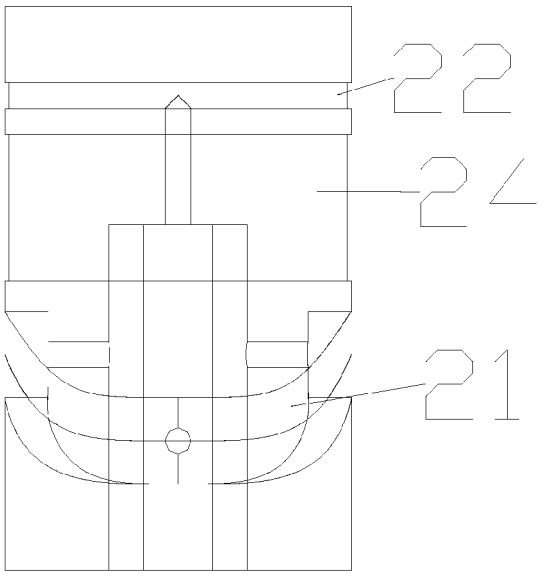
FIG. 7 shows a front view of the piston in FIG. 6.
Figure 8:
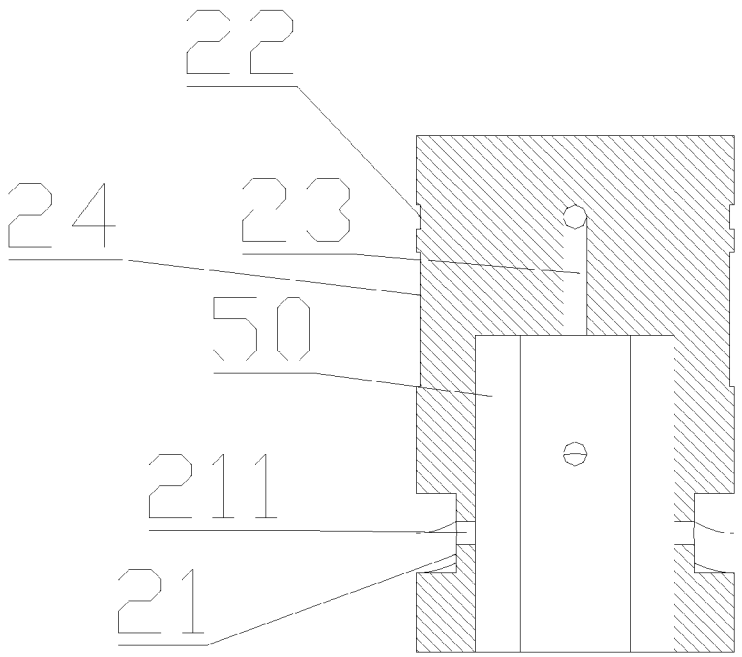
FIG. 8 shows a cross-sectional view of the piston in FIG. 6.
Figure 9:
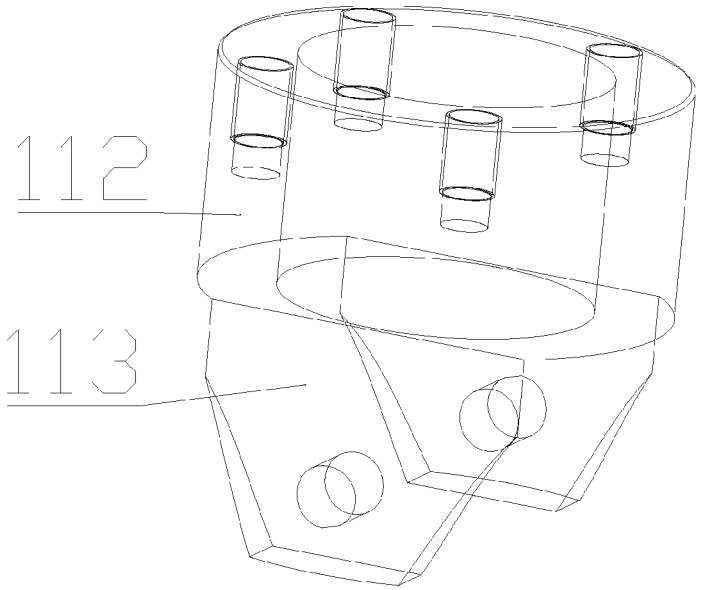
FIG. 9 shows a schematic structural view of a cylinder in FIG. 2.
Figure 10:
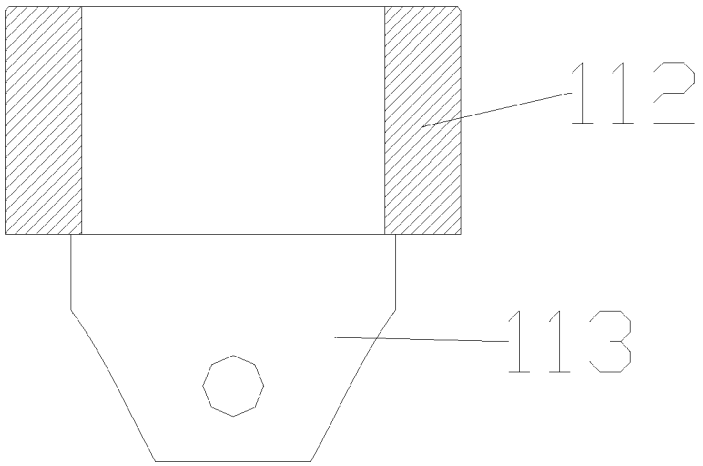
FIG. 10 shows a cross-sectional view of the cylinder in FIG. 9.
Figure 11:
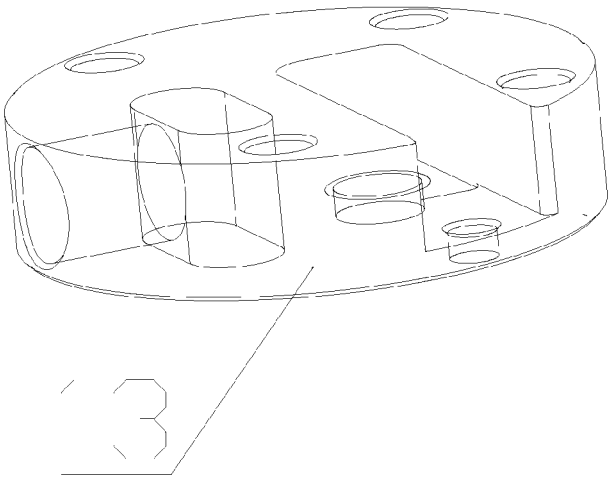
FIG. 11 shows a schematic structural view of a cylinder cover in FIG. 2.
Figure 12:
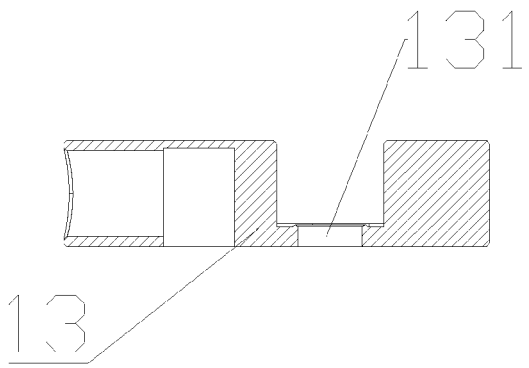
FIG. 12 shows a cross-sectional view of the cylinder cover in FIG. 11.
Figure 13:
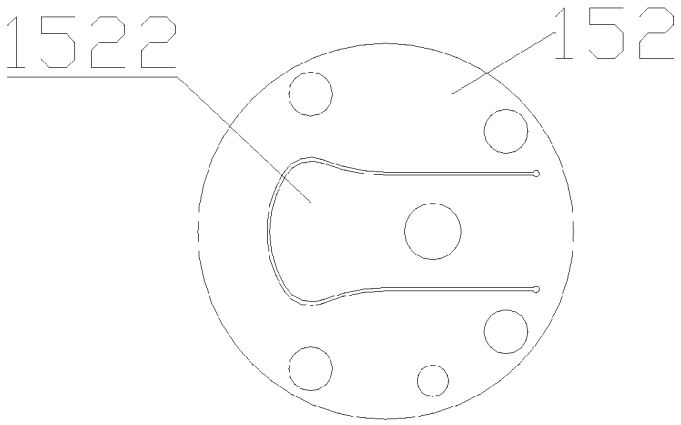
FIG. 13 shows a schematic structural view of a gas suction valve plate in FIG. 2.
Figure 14:
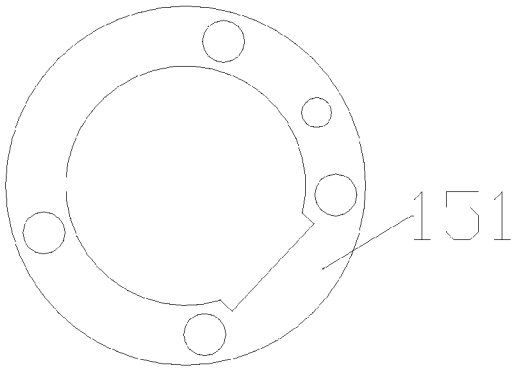
FIG. 14 shows a schematic structural view of a gas suction valve plate washer in FIG. 2.
Figure 15:
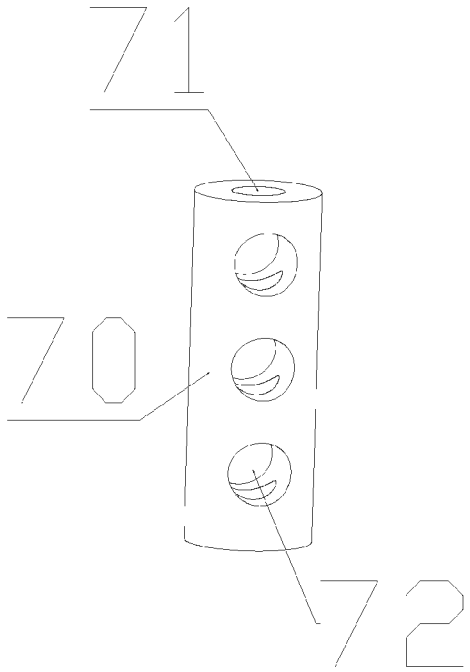
FIG. 15 shows a schematic structural view of a support shaft in FIG. 1.

Referring to FIG. 5, in some embodiments of the present disclosure, an outer peripheral surface of the end of the shaft member extending into the piston 20 includes a first radial-support arc surface 41, a first circumferential-support flat surface 42, a second circumferential-support flat surface 43, a third circumferential-support flat surface 44, a second radial-support arc surface 45, a fourth circumferential-support flat surface 46, a fifth circumferential-support flat surface 47, and a sixth circumferential-support flat surface 48 connected end to end in sequence. The first radial-support arc surface 41 and the second radial-support arc surface 45 are symmetrically arranged, the second circumferential-support flat surface 43 and the fifth circumferential-support flat surface 47 are symmetrically arranged, the first circumferential-support flat surface 42 and the third circumferential-support flat surface 44 are symmetrically arranged, and the fourth circumferential-support flat surface 46 and the sixth circumferential-support flat surface 48 are symmetrically arranged. With this arrangement, while making the piston 20 and the shaft member rotate synchronously, the friction between the piston 20 and the shaft member can be reduced when the piston 20 moves back and forth relative to the cylinder 11. Moreover, in this arrangement, the shaft member can respectively provide axial and circumferential supporting forces to the piston 20 to transfer loads.

In some embodiments, the cross-sectional area of the first end of the shaft member is larger than the cross-sectional area of the second end of the shaft member. With this arrangement, the connection strength between the shaft member and the piston 20 can be effectively ensured, so as to prevent the shaft member from breaking at the connection with the piston 20.

In some embodiments, the rail groove 21 is located in the outer circumferential wall of the piston 20. The motion transmission structure 40 is a shaft member. The first end of the shaft member extends into the piston 20, and the outer peripheral wall of the piston 20 is provided with an oil groove 22. The piston 20 includes at least one piston radial oil-port 211 and at least one piston central oil-port 23. The piston radial oil-port 211 is disposed in the bottom wall of the oil groove 22 and/or the bottom wall of the rail groove 21. The piston radial oil-port 211 is communicated with the shaft member located in the piston 20 through the piston central oil-port 23.

In some embodiments, the shaft member has a shaft member central oil-port 49 and a shaft member radial oil-port 491 communicated with each other. The shaft member central oil-port 49 penetrates an end surface of the shaft member in the axial direction.

By arranging the piston radial oil-port 211, the piston central oil-port 23, the shaft member radial oil-port 491, and the shaft member central oil-port 49, the location between the guide structure 111 and rail groove 21, and the location between the piston 20 and the shaft member can be effectively lubricated. Therefore, the friction between the guide structure 111 and the rail groove 21 and the friction between the piston 20 and the shaft member can be further reduced.

In some embodiments, the pump body further includes a support shaft 70. The support shaft 70 supports a second end of the shaft member. The support shaft 70 has a support shaft central oil-port 71 and at least one support shaft radial oil-port 72. The support shaft central oil-port 71 is communicated with the shaft member central oil-port 49. When there are multiple support shaft radial oil-ports 72, the multiple support shaft radial oil-ports 72 are spaced from each other along the axial direction of the support shaft 70. In the present disclosure, the support shaft 70 mainly functions as a support for the shaft member, and an end surface of the support shaft 70 away from the shaft member is welded to the compressor housing.

In some embodiments, the outer peripheral wall of the piston 20 is further provided with a clearance slot 24, and the clearance slot 24 is located between the rail groove 21 and the oil groove 22. With this arrangement, when the piston 20 moves relative to the cylinder 11, unnecessary wear between the piston 20 and the cylinder 11 can be effectively avoided.

Moreover, in some embodiments, the main body of the piston 20 is a column with a certain degree of roughness.

In some embodiments, the cylinder 11 includes a cylinder body 112 and a support protrusion 113. The support protrusion 113 is arranged on an end surface of the cylinder body 112 facing the motion transmission structure 40, and the guide structure 111 is disposed on the support protrusion 113. With this arrangement, the contact area between the piston 20 and the cylinder 11 can be further reduced, thereby effectively reducing the wear between the cylinder 11 and the piston 20.

In an embodiment of the present disclosure, the cylinder assembly 10 further includes a flange, and the flange is in interference fit with the side of the cylinder body 112 away from the support protrusion 113.

In some embodiments, the cylinder assembly 10 further includes a cylinder cover 13, a gas discharge valve assembly 14, and a gas suction valve assembly 15. The gas suction valve assembly 15 is disposed between the cylinder 11 and the cylinder cover 13, and the gas discharge valve assembly 14 is disposed on a cylinder cover gas exhaustion port 131 of the of the cylinder cover 13. This arrangement can effectively ensure the normal suction, compression, and exhaust of the pump body.

In some embodiments, the gas suction valve assembly 15 includes a gas suction valve plate washer 151 and a gas suction valve plate 152. The gas suction valve plate washer 151 is ring-shaped. The gas suction valve plate 152 is disposed between the cylinder cover 13 and the gas suction valve plate washer 151. The gas suction valve plate 152 has a gas suction port 1521 and a spring plate 1522 movably disposed at the gas suction port 1521. The spring plate 1522 opens during gas suction of the pump body. The gas suction valve plate 152 also has a valve plate gas discharge port 1523 disposed corresponding to the cylinder cover gas exhaustion port 131.

In some embodiments, the valve plate gas discharge port 1523 is located in the spring plate 1522. With this arrangement, the spring plate 1522 can be effectively prevented from being opened during the gas exhaust process of the pump body, and thus the gas can be prevented from being exhausted from the gas suction port 1521.

The specific gas suction and exhaust process is that when the pressure inside the cylinder 11 is lower than the pressure outside the cylinder 11, the spring plate 1522 is opened and the gas enters the cylinder 11, and when the pressure inside the cylinder 11 is higher than the pressure outside the cylinder 11, the gas discharge valve plate is opened, and the gas is discharged from the cylinder 11 through the valve plate gas discharge port 1523.

In some embodiments, the spring plate 1522 is formed from a part of the gas suction valve plate 152 by cutting, and is integrated with the gas suction valve plate 152. An opening formed by the cutting forms the gas suction port 1521. With this arrangement, the sealing performance between the spring plate 1522 and the gas suction valve plate 152 can be effectively ensured, thereby ensuring the working efficiency of the pump body.

In some embodiments, the movement of the piston 20 relative to the cylinder 11 satisfies a trigonometric function, and a center of mass of the cylinder 11 corresponds to a balance surface where the amplitude of the trigonometric function is zero, and the center of mass of the piston 20 continuously moves relative to the balance surface during the movement of the piston 20 to form a trigonometric function curve. In the present disclosure, when the piston 20 is in the initial position, the line connecting the center of mass of the piston 20 and the center of mass of the cylinder 11 is perpendicular to the axis of the piston 20 or the cylinder 11. When the piston 20 moves relative to the cylinder 11, the center of mass of the piston 20 moves up and down relative to the center of mass of the cylinder 11, and the position of the center of mass of the piston 20 relative to the center of mass of the cylinder 11 satisfies a functional relationship with the moving time of the piston 20, and the functional relationship is a sine function curve or a cosine function curve.

It can be seen from the above description that the above-described embodiments of the present disclosure achieve at least one of the following technical effects:

1. The transmission efficiency of the pump body is improved, and the displacement of the pump body is increased.
2. The eccentric rotation problem of the pump body is solved.
3. The structure is simple, and the gas leakage of the pump body is reduced.

Obviously, the embodiments described above are only a part of the embodiments of the present disclosure, rather than all of the embodiments. Based on the embodiments in the present disclosure, all other embodiments obtained by those of ordinary skill in the art without creative work should fall within the protection scope of the present disclosure.

It should be noted that the terms used herein are only for describing specific embodiments, and are not intended to limit the exemplary embodiments according to the present disclosure. As used herein, unless the context clearly indicates otherwise, the singular form is also intended to include the plural form. In addition, it should also be understood that when the terms "comprise" and/or "include" are used in the specification, they indicate that there are features, steps, works, devices, components, and/or combinations thereof.

The terms "first", "second", etc. in the specification and claims of the present disclosure and the drawings are used to distinguish similar objects, and are not necessarily used to describe a specific sequence or order. It should be understood that the data used in this way can be interchanged under appropriate circumstances so that the embodiments of the present disclosure described herein can be implemented in a sequence other than those illustrated or described herein.

The above descriptions are only preferred embodiments of the present disclosure and are not intended to limit the present disclosure. For those skilled in the art, the present disclosure may have various modifications and changes. Any modification, equivalent replacement, improvement, etc. made within the spirit and principle of the present disclosure shall be included in the protection scope of the present disclosure.

What is claimed is:

1. A pump body, comprising:

a cylinder assembly, comprising a cylinder;

a piston, movably disposed in the cylinder;

a motion transmission structure; and a drive member, drivingly connected to the piston through the motion transmission structure, wherein an outer peripheral wall of the piston has a rail groove connected end to end in a circumferential direction, and the cylinder has a guide structure extending into the rail groove , or an inner surface of the cylinder has a rail groove connected end to end in a circumferential direction, and the piston has a guide structure extending into the rail groove, and thus through driving of the piston by the drive member, the piston is capable of rotating relative to the cylinder while reciprocating along a rotating axis of the piston;

wherein the rail groove is a continuous wave-shaped curved line rail groove;

wherein the wave-shaped curved line rail groove is a sine or cosine wave-shaped curved line rail groove; and wherein numbers of crests and troughs of the sine or cosine wave-shaped curved line rail groove in the circumferential direction of the cylinder or the piston are equal, and both numbers of the crests and the troughs are greater than or equal to 2.

2. The pump body according to claim 1, wherein the piston has one or a plurality of guide structures, and when the piston has the plurality of guide structures, the number of the guide structures is equal to or smaller than the number of the crests, and the plurality of guide structures are in a same radial plane of the piston.

3. The pump body according to claim 1, wherein the guide structure comprises a pin or a rolling bearing extending into the rail groove.

4. The pump body according to claim 1, wherein the motion transmission structure comprises a shaft member, the shaft member is arranged coaxially with the rotating axis of the piston, and the piston is sleeved on the shaft member; when the shaft member rotates, the piston rotates synchronously with the shaft member and slides back and forth along the rotating axis.

5. The pump body according to claim 4, wherein a first end of the shaft member extends into the piston, the drive member is located at a second end of the shaft member, the shaft member comprises a first circumferential anti-rotation structure located at the end extending into the piston, and the piston comprises a second circumferential anti-rotation structure that cooperates with the first circumferential anti-rotation structure.

6. The pump body according to claim 5, wherein the first circumferential anti-rotation structure is a guide groove located on an outer peripheral surface of the shaft member and extending along an axial direction of the shaft member, the second circumferential anti-rotation structure is a guide protrusion extending into the guide groove, and with movement of the piston, the guide protrusion moves back and forth in the guide groove; or the second circumferential anti-rotation structure is a guide groove located on the piston and extending along the rotating axis, the first circumferential anti-rotation structure is a guide protrusion extending into the guide groove, and with movement of the piston, the guide protrusion moves back and forth in the guide groove.

7. The pump body according to claim 4, wherein a cross section of an end of the shaft member extending into the piston is a non-circular cross section.

8. The pump body according to claim 7, wherein an outer peripheral surface of the end of the shaft member extending into the piston comprises a first radial-support arc surface, a first circumferential-support flat surface, a second circumferential-support flat surface, a third circumferential-support flat surface, a second radial-support arc surface, a fourth circumferential-support flat surface, a fifth circumferential-support flat surface, and a sixth circumferential-support flat surface, which are connected end to end in sequence, wherein the first radial-support arc surface and the second radial-support arc surface are symmetrically arranged, the second circumferential-support flat surface and the fifth circumferential-support flat surface are symmetrically arranged, the first circumferential-support flat surface and the third circumferential-support flat surface are symmetrically arranged, and the fourth circumferential-support flat surface and the sixth circumferential-support flat surface are symmetrically arranged.

9. The pump body according to claim 1, wherein the cylinder comprises:

a cylinder body; and a support protrusion, the support protrusion is arranged on an end surface of the cylinder body facing the motion transmission structure, and the guide structure of the cylinder is disposed on the support protrusion.

10. The pump body according to claim 1, wherein the cylinder assembly further comprises a cylinder cover, a gas discharge valve assembly, and a gas suction valve assembly; the gas suction valve assembly is disposed between the cylinder and the cylinder cover, and the gas discharge valve assembly is disposed on a cylinder cover gas exhaustion port of the cylinder cover;

wherein the gas suction valve assembly comprises:

a gas suction valve plate washer, the gas suction valve plate washer being ring-shaped;

a gas suction valve plate, the gas suction valve plate being disposed between the cylinder cover and the gas suction valve plate washer, wherein the gas suction valve plate has a gas suction port and a spring plate movably disposed at the gas suction port, the spring plate is configured to open during gas suction of the pump body, the gas suction valve plate also has a valve plate gas discharge port disposed corresponding to the cylinder cover gas exhaustion port.

11. The pump body according to claim 10, wherein the spring plate is disposed at the valve plate gas discharge port;

wherein the spring plate is formed from a part of the gas suction valve plate by cutting, and is integrated with the gas suction valve plate; an opening formed by the cutting forms the gas suction port.

12. The pump body according to claim 1, wherein movement of the piston relative to the cylinder satisfies a trigonometric function, and a center of mass of the cylinder corresponds to a balance surface where the amplitude of the trigonometric function is zero, and a center of mass of the piston continuously moves relative to the balance surface during the movement of the piston to form a trigonometric function curve.

13. A compressor, comprising the pump body according to claim 1.

14. A heat exchange apparatus, comprising the compressor according to claim 13.

15. The heat exchange apparatus according to claim 14, wherein the heat exchange apparatus is an air conditioner.

16. A pump body, comprising:

a cylinder assembly, comprising a cylinder;

a piston, movably disposed in the cylinder;

a motion transmission structure; and a drive member, drivingly connected to the piston through the motion transmission structure, wherein an outer peripheral wall of the piston has a rail groove connected end to end in a circumferential direction, and the cylinder has a guide structure extending into the rail groove, or an inner surface of the cylinder has a rail groove connected end to end in a circumferential direction, and the piston has a guide structure extending into the rail groove, and thus through driving of the piston by the drive member, the piston is capable of rotating relative to the cylinder while reciprocating along a rotating axis of the piston;

wherein the rail groove is a continuous wave-shaped curved line rail groove;

wherein the wave-shaped curved line rail groove is a sine or cosine wave-shaped curved line rail groove;

wherein the piston has one or a plurality of guide structures, and a displacement (Vone) of the pump body satisfies the following relationship:

$$\text{Vone}=K1*K2*A*S \qquad \text{formula (1)}$$

wherein K1 is a coefficient, and K1 is an integer greater than zero; K2 is the number of the guide structure; A is the amplitude of the sine or cosine wave-shaped curved line rail groove; S is the area of an end surface of the piston, and the end surface faces a compression cavity of the cylinder.

17. A pump body, comprising:

a cylinder assembly, comprising a cylinder;

a piston, movably disposed in the cylinder;

a motion transmission structure; and a drive member, drivingly connected to the piston through the motion transmission structure, wherein an outer peripheral wall of the piston has a rail groove connected end to end in a circumferential direction, and the cylinder has a guide structure extending into the rail groove, or an inner surface of the cylinder has a rail groove connected end to end in a circumferential direction, and the piston has a guide structure extending into the rail groove, and thus through driving of the piston by the drive member, the piston is capable of rotating relative to the cylinder while reciprocating along a rotating axis of the piston;

wherein the rail groove is located in the outer peripheral wall of the piston, and the motion transmission structure comprises a shaft member, a first end of the shaft member extends into the piston, the outer peripheral wall of the piston has an oil groove, and the piston comprises:

at least one piston radial oil-port, the piston radial oil-port being disposed in at least one of a bottom wall of the oil groove and a bottom wall of the rail groove;

at least one piston central oil-port, the piston radial oil-port being communicated with the shaft member located in the piston through the piston central oil-port.

* * * * *